US011124735B2

(12) United States Patent
Kimoto et al.

(10) Patent No.: US 11,124,735 B2
(45) Date of Patent: Sep. 21, 2021

(54) INITIAL RUNNING-IN AGENT COMPOSITION AND INITIAL RUNNING-IN SYSTEM INCLUDING SAID COMPOSITION

(71) Applicants: DAICEL CORPORATION, Osaka (JP); TOHOKU UNIVERSITY, Sendai (JP)

(72) Inventors: Norihiro Kimoto, Tokyo (JP); Tomohiro Goto, Tokyo (JP); Koshi Adachi, Sendai (JP); Tsubasa Takahashi, Sendai (JP)

(73) Assignees: DAICEL CORPORATION, Osaka (JP); TOHOKU UNIVERSITY, Sendai (JP)

( * ) Notice: Subject to any disclaimer, the term of this patent is extended or adjusted under 35 U.S.C. 154(b) by 0 days.

(21) Appl. No.: 16/762,550

(22) PCT Filed: Oct. 25, 2018

(86) PCT No.: PCT/JP2018/039646
§ 371 (c)(1),
(2) Date: May 8, 2020

(87) PCT Pub. No.: WO2019/093141
PCT Pub. Date: May 16, 2019

(65) Prior Publication Data

US 2020/0339908 A1 Oct. 29, 2020

(30) Foreign Application Priority Data

Nov. 9, 2017 (JP) ..... JP2017-216442

(51) Int. Cl.
*C10M 173/02* (2006.01)
*C10M 125/02* (2006.01)
*C10N 40/10* (2006.01)

(52) U.S. Cl.
CPC ..... *C10M 173/02* (2013.01); *C10M 125/02* (2013.01); *C10M 2201/041* (2013.01); *C10N 2040/10* (2013.01)

(58) Field of Classification Search
CPC ..... C10M 173/02; C10M 125/02; C10M 2201/041; C10N 2040/10
See application file for complete search history.

(56) References Cited

U.S. PATENT DOCUMENTS 10,844,313 B2 * 11/2020 Kimoto ..... C10M 173/02
2003/0228249 A1 * 12/2003 Fujimura ..... C25D 15/02 423/446

(Continued)

FOREIGN PATENT DOCUMENTS

CN 101519621 A 9/2009
JP 2010-255682 A 11/2010
JP 2012-246545 A 12/2012

OTHER PUBLICATIONS

International Search Report dated Jan. 15, 2019, in PCT/JP2018/039646.

(Continued)

*Primary Examiner* — Ellen M McAvoy
(74) *Attorney, Agent, or Firm* — Birch, Stewart, Kolasch & Birch, LLP

(57) ABSTRACT

The present invention provides an initial running-in agent composition suitable for forming a low-friction surface (running-in surface) on a sliding member, such as a hard carbon film, in a system in which water is used as a lubricant. The initial running-in agent composition (10) according to an embodiment of the present invention contains water 11 as a lubricant base and nanodiamond particles (12). In the initial running-in agent composition (10), a content of the water (11) is preferably 99 mass % or greater, and a content (Continued)

of the nanodiamond particles (12) is preferably 1.0 mass % or less.

20 Claims, 9 Drawing Sheets

(56) References Cited

U.S. PATENT DOCUMENTS

2008/0248979 A1* 10/2008 Nakagawa ..... C10M 169/04 508/128
2010/0029518 A1* 2/2010 Markovitz ..... C10M 141/00 508/113
2011/0059876 A1* 3/2011 Takahama ..... C10M 173/02 508/113
2011/0172132 A1* 7/2011 Branson ..... C10M 103/02 508/126
2012/0308949 A1* 12/2012 Hirose ..... C23C 16/50 432/52
2014/0047974 A1* 2/2014 Sugimoto ..... F16J 9/26 92/172
2015/0038593 A1* 2/2015 Gogotsi ..... A61K 47/02 514/769
2016/0060563 A1* 3/2016 Kim ..... C10M 161/00 508/287
2016/0068398 A1* 3/2016 Myllymaki ..... C09G 1/04 508/122
2016/0102188 A1* 4/2016 Myllymaki ..... C08L 77/06 252/75
2016/0115033 A1* 4/2016 Myllymaki ..... B01J 13/0026 516/32
2017/0313590 A1* 11/2017 Kimoto ..... B02C 17/00
2017/0368527 A1* 12/2017 Arnold ..... B01J 19/081
2018/0223208 A1* 8/2018 Sumant ..... B05D 1/02
2019/0218475 A1* 7/2019 Kimoto ..... C10M 103/02
2020/0087594 A1* 3/2020 Kimoto ..... C01B 32/26
2020/0189916 A1* 6/2020 Umemoto ..... C01B 32/28

OTHER PUBLICATIONS

Mochalin et al., "The properties and applications of nanodiamonds," Nature Nanotechnology [online], Dec. 18, 2011, http://www.nature.com/naturenanotechnology, pp. 1-13
Written Opinion dated Jan. 15, 2019, in PCT/JP2018/039646.
Extended European Search Report, dated Jul. 12, 2021, for European Application No. 18876296.7.
Uchida et al., "Development of Wide Frequency Range Ultrasound Exposure System for Dispersion of Nano Diamond Partices," 2005 IEEE Ultrasonics Symposium, Rotterdam. The Netherlands, vol. 1, Sep. 18, 2005, pp. 277-280, XP010898894.

* cited by examiner

INITIAL RUNNING-IN AGENT COMPOSITION AND INITIAL RUNNING-IN SYSTEM INCLUDING SAID COMPOSITION

TECHNICAL FIELD

The present invention relates to an initial running-in agent composition and an initial running-in system including the composition. The present application claims priority to JP 2017-216442, filed on 9 Nov. 2017, the entire content of which is incorporated herein by reference.

BACKGROUND ART

In a machine that has a portion sliding while relatively rubbing (sliding portion), an initial running-in agent is used at an initial stage to gradually plastically deform the friction surface on the sliding portion, smooth the friction surface (to enlarge the pressure-receiving area), and form a running-in surface suitable for abrasion on the sliding portion.

At present, surface modification technology is attracting attention as a technique for improving tribological properties in parts used in sliding portions, and various hard films other than metals are studied as measures to reduce friction and abrasion of sliding portions. Among them, a hard carbon (diamond-like carbon; DLC) film has high hardness and friction resistance and is also excellent in reducing a coefficient of friction, and thus is expected to be applied to machine parts having a sliding portion. Use of such a hard carbon film on a sliding member is described, for example, in Patent Document 1 below.

Water is mainly used as a lubricant on a hard carbon film, such as a DLC. The use of water as a lubricant on a hard carbon film is expected to achieve very low friction. In addition, the use of water as a lubricant is also preferred in terms of environmental impact. Such use of water as a lubricant for a sliding member of a hard carbon film, such as a DLC, is described in, for example, Non-Patent Literature 1 below. Non-Patent Literature 1 describes that to form a low-friction surface (running-in surface) on the DLC film, abrasion (pre-sliding) is applied in advance in the atmosphere.

CITATION LIST

Patent Document

Patent Document 1: JP 2012-246545 A

Non-Patent Literature

Non-Patent Literature 1: Tribology Conference 2015 Spring, Himeji, Collection of Abstracts of Papers, "Effect of Running-in on Achieving Low Friction of DLC Films in Water", 288-289

SUMMARY OF INVENTION

Technical Problem

The present invention has been conceived under the circumstances as described above and provides an initial running-in agent composition suitable for forming a low-friction surface (running-in surface) on a sliding member, such as a hard carbon film, in a system in which water is used as a lubricant, and an initial running-in system in which the composition is used.

Solution to Problem

A first aspect of the present invention provides an initial running-in agent composition. This initial running-in agent composition contains water as a lubricant base and nanodiamond particles (which may be hereinafter referred to as "ND particles"). The initial running-in agent composition according to the first aspect is used to form a low-friction surface (running-in surface) at an initial stage of a machine having a sliding member. After forming the low-friction surface (running-in surface), the initial running-in agent composition is removed, and sliding (abrasion) using mainly water is performed. The present inventors used an initial running-in agent composition containing ND particles to evaluate a coefficient of friction between predetermined sliding members and found that the coefficient of friction is significantly reduced. This is, for example, as described in Examples below. The reason for the significant reduction in a coefficient of friction is believed to be due to formation of a surface having both smoothness and wettability through a tribochemical reaction in a system in which ND particles are present on the sliding member. An embodiment of the present invention is suitable for achieving low friction between sliding members at an early stage through formation of a low-friction surface (running-in surface) and improvement of the wettability of the friction surface between the members having a hard carbon film, for example, such as a diamond-like carbon (DLC), on the sliding portion.

In an embodiment of the present invention, a content of water is preferably 99 mass % or greater, and a content of the ND particles is preferably 1.0 mass % or less. Furthermore, the content of the ND particles is particularly preferably from 0.5 to 2000 ppm by mass. An embodiment of the present invention is suitable for efficiently achieving low friction while reducing the content of the ND particles to be contained. Reducing the content of the ND particles is particularly preferred in terms of reducing the production cost of the initial running-in agent composition.

In an embodiment of the present invention, the ND particles may be an oxygen oxidation product of detonation nanodiamond particles. The detonation method can appropriately produce ND having a particle size of the primary particles of 10 nm or smaller. In addition, the oxygen oxidation product of detonation ND particles is suitable for achieving low friction between the sliding members at an early stage through formation of a low-friction surface (running-in surface) and improvement of the wettability of the friction surface.

In an embodiment of the present invention, a zeta potential of the ND may be negative.

In an embodiment of the present invention, a peak position attributed to C=O stretching vibration in FT-IR of the ND particles may be 1750 $cm^{-1}$ or greater.

In an embodiment of the present invention, the ND particles may be a hydrogen reduction product of detonation nanodiamond particles. The detonation method can appropriately produce ND having a particle size of the primary particles of 10 nm or smaller. In addition, the hydrogen reduction product of detonation ND particles is suitable for achieving low friction between the sliding members at an early stage through formation of a running-in surface suitable for rubbing and improvement of the wettability of the friction surface.

In an embodiment of the present invention, the zeta potential of the ND may be positive.

In an embodiment of the present invention, the peak position attributed to C═O stretching vibration in FT-IR of the ND particles may be less than 1750 $cm^{-1}$.

An embodiment of the present invention is preferably used for lubricating a DLC member. An embodiment of the present invention is suitable for achieving low friction between DLC members through formation of a running-in surface suitable for rubbing and improvement of the wettability of the friction surface between the members.

A second aspect of the present invention provides an initial running-in system. This initial running-in system is an initial running-in system between DLC members, in which the initial running-in agent composition is used. An initial running-in system thus constituted is suitable for achieving low friction in lubrication of a diamond-like carbon (DLC) sliding member.

DESCRIPTION OF EMBODIMENTS

Figure 1:
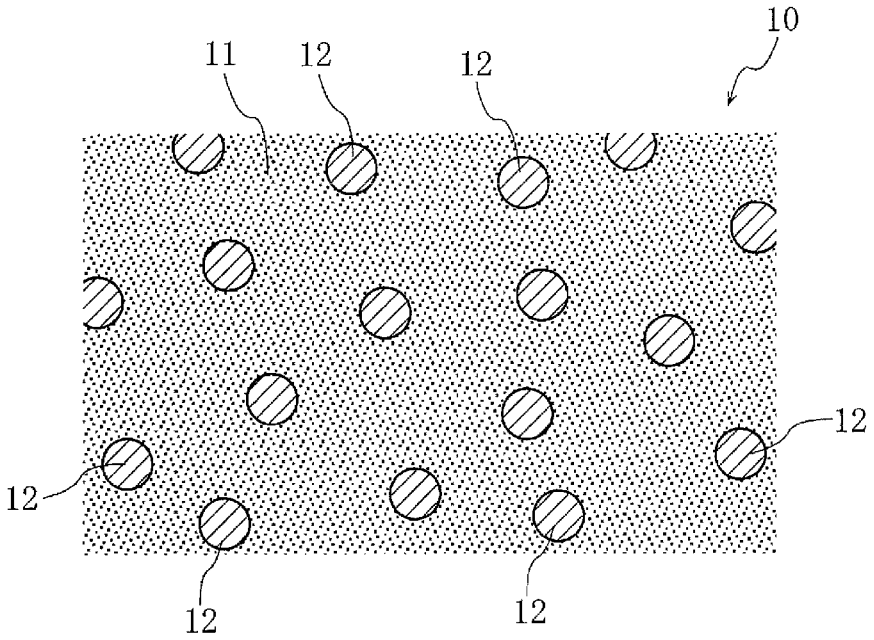
FIG. 1 is an enlarged schematic view of an initial running-in agent composition according to one embodiment of the present invention.
Figure 2:
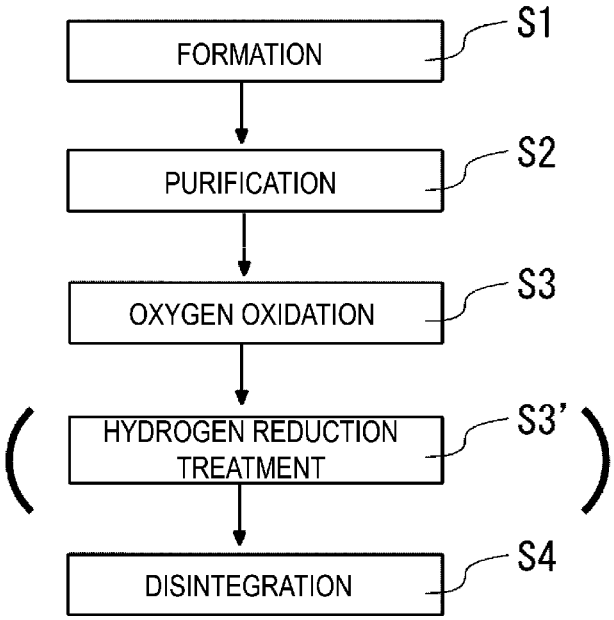
FIG. 2 is a flow diagram of an example of a method for producing an ND dispersion according to one embodiment of the present invention.

FIG. 1 is an enlarged schematic view of an initial running-in agent composition 10 according to one embodiment of the present invention. The initial running-in agent composition 10 contains: water 11 as a lubricant base; ND particles 12; and an additional component added as necessary. The initial running-in agent composition 10 is used for initial rubbing (sliding) to form a low friction (running-in) surface between members having a hard carbon film, such as a DLC, on a sliding portion.

In the present embodiment, the content of the water 11 in the initial running-in agent composition 10 is, for example, 99 mass % or greater, preferably 99.5 mass % or greater, more preferably 99.9 mass % or greater, and more preferably 99.99 mass % or greater.

In the present embodiment, the content or concentration of the ND particles 12 in the initial running-in agent 10 is 1.0 mass % (10000 ppm by mass) or less, preferably from 0.00005 to 0.5 mass %, more preferably from 0.0001 to 0.4 mass %, more preferably from 0.0005 to 0.3 mass %, and more preferably from 0.001 to 0.2 mass %. The content of the ND particles 12 is preferably from 0.5 to 2000 ppm by mass. The content of the ND particles 12 within the above range is suitable for efficiently achieving low friction while reducing the content of the ND particles to be contained.

The ND particles 12 contained in the initial running-in agent composition 10 are dispersed as primary particles separated from each other in the initial running-in agent composition 10. The particle size of the primary particles of the nanodiamond is, for example, 10 nm or smaller. The lower limit of the particle size of the primary particles of the nanodiamond is, for example, 1 nm. The particle size D50 (median diameter) of the ND particles 12 in the initial running-in agent composition 10 is, for example, 10 nm or smaller, preferably 9 nm or smaller, more preferably 8 nm or smaller, more preferably 7 nm or smaller, and more preferably 6 nm or smaller. The particle size D50 of the ND particles 12 can be measured, for example, by the dynamic light scattering method.

The ND particles 12 contained in the initial running-in agent composition 10 are preferably detonation ND particles (ND particles formed by the detonation method). The detonation method can appropriately produce ND having a particle size of primary particles of 10 nm or smaller.

The ND particles 12 contained in the initial running-in agent composition 10 may be an oxygen oxidation product of the detonation ND particles. In the oxygen oxidation product, the peak position attributed to C═O stretching vibration in FT-IR of the ND particles tends to be 1750 $cm^{-1}$ or greater, and the zeta potential of the ND particles at this time tends to be negative. An oxygen oxidation treatment of the detonation ND particles is described in the oxygen oxidation in the production process described below.

In addition, the ND particles 12 contained in the initial running-in agent composition 10 may be a hydrogen reduction product of the detonation ND particles. In the hydrogen reduction product, the peak position attributed to C═O stretching vibration in FT-IR of the ND particles tends to be less than 1750 $cm^{-1}$, and the zeta potential of the ND particles at this time tends to be positive. A hydrogen reduction treatment of the detonation ND particles is described in the hydrogen reduction treatment in the production process described below.

When the value of called zeta potential of the ND particles 12 contained in the initial running-in agent composition 10 is negative, the value is, for example, from −60 to −30 mV. For example, employing a relatively high temperature (e.g., from 400 to 450° C.) for the temperature condition of the oxygen oxidation treatment in the production process as described below can bring the zeta potential of the ND particles 12 to a negative value. When the value of the zeta potential is positive, the value is, for example, from 30 to 60 mV. For example, in the production process, performing a hydrogen reduction treatment after the oxygen oxidation as described below can bring the zeta potential of the ND particles 12 to a positive value.

The initial running-in agent composition 10 may contain an additional component in addition to the water 11 and the ND particles 12 as described above. Examples of the additional component include surfactants, thickeners, coupling agents, anti-rust agents for preventing rust of metal members that are members to be lubricated, corrosion inhibitors for preventing corrosion of non-metal members that are members to be lubricated, freezing point depressants, anti-foaming agents, anti-wear additives, antiseptics, colorants, and solid lubricants other than the ND particles 12.

The initial running-in agent composition 10 as described above can be produced by mixing the ND dispersion obtained by a method described below and a desired component, such as water. The ND dispersion can be produced, for example, through processes including formation S1, purification S2, oxygen oxidation S3, and disintegration S4 described below.

In the formation S1, the nanodiamond is formed, for example, by a detonation method. Specifically, first, an electric detonator is attached to a molded explosive and then placed inside a pressure-resistant detonation vessel, and the vessel is sealed in a state in which a predetermined gas and the explosive to be used coexist inside the vessel. The vessel is made of, for example, iron and has a capacity from, for example, 0.5 to 40 $m^3$. A mixture of trinitrotoluene (TNT) and cyclotrimethylenetrinitramine, namely, hexogen (RDX), can be used as the explosive. The mass ratio of TNT and RDX (TNT/RDX) is, for example, in a range from 40/60 to 60/40. The explosive is used in an amount, for example, from 0.05 to 2.0 kg. The gas sealed in the vessel together with the explosive to be used may have an atmospheric composition or may be an inert gas. In terms of forming nanodiamond having a small amount of a functional group on the surface of the primary particles, the gas sealed in the vessel together with the explosive to be used is preferably an inert gas. That is, in terms of forming nanodiamond having a small amount of a functional group on the surface of the primary particles, the detonation method for forming nanodiamond is preferably performed in an inert gas atmosphere. As the inert gas, for example, at least one selected from nitrogen, argon, carbon dioxide, and helium can be used.

In the formation S1, the electric detonator is then triggered to detonate the explosive in the vessel. "Detonation" refers to an explosion, among those associated with a chemical reaction in which a flame surface where the reaction occurs travels at a high speed exceeding the speed of sound. During the detonation, the explosive used partially causes incomplete combustion and releases free carbon, and nanodiamond is formed from the carbon as a raw material by the action of the pressure and energy of a shock wave generated in the explosion. The detonation method can appropriately produce nanodiamond having a particle size of primary particles of 10 nm or smaller as described above. The nanodiamond forms an aggregate first in a product obtained by the detonation method, and in the aggregate, adjacent primary particles or crystallites very firmly aggregate with each other by contribution of Coulomb interaction between crystal planes in addition to the action of Van der Waals forces.

In the formation S1, then the temperatures of the vessel and the inside of the vessel are reduced by allowing the vessel to stand at room temperature, for example, for 24 hours. After this cooling, a nanodiamond crude product is collected. The nanodiamond crude product can be collected, for example, by scraping with a spatula the nanodiamond crude product (containing the nanodiamond aggregates formed as described above and soot) deposited on the inner wall of the vessel. By the detonation method as described above, a crude product of the nanodiamond particles can be obtained. In addition, the desired amount of the nanodiamond crude product can be obtained by performing the formation S1 as described above a necessary number of times.

In the present embodiment, the purification S2 includes an acid treatment that allows a strong acid to act on the raw material nanodiamond crude product, for example, in a water solvent. The nanodiamond crude product obtained by the detonation method is prone to contain a metal oxide, which is an oxide of a metal, such as Fe, Co, or Ni, derived from a vessel or the like used in the detonation method. The metal oxide can be dissolved and removed from the nanodiamond crude product by allowing a predetermined strong acid to act on the nanodiamond crude product (acid treatment), for example, in a water solvent. The strong acid used in the acid treatment is preferably a mineral acid, and examples of the strong acid include hydrochloric acid, hydrofluoric acid, sulfuric acid, nitric acid, and aqua regia. In the acid treatment, one strong acid may be used, or two or more strong acids may be used. The concentration of the strong acid used in the acid treatment is, for example, from 1 to 50 mass %. The acid treatment temperature is, for example, from 70 to 150° C. The duration of the acid treatment is, for example, from 0.1 to 24 hours. In addition, the acid treatment can be performed under reduced pressure, under normal pressure, or under increased pressure. After such an acid treatment, the solid (containing the nanodiamond aggregates) is washed with water, for example, by decantation. The solid is preferably repeatedly washed with water by decantation until the pH of the precipitation solution reaches, for example, 2 to 3. If the content of the metal oxide in the nanodiamond crude product obtained by the detonation method is small, the acid treatment as described above may be omitted.

In the present embodiment, the purification S2 includes an oxidation treatment for removing non-diamond carbon, such as graphite or amorphous carbon, from the nanodiamond crude product (nanodiamond aggregates prior to completion of the purification) using an oxidizing agent. The nanodiamond crude product obtained by the detonation method contains non-diamond carbon, such as graphite (black lead) and amorphous carbon, derived from carbon having not formed nanodiamond crystals, in the carbon released by a partially incomplete combustion of the explosive used. For example, the non-diamond carbon can be removed from the nanodiamond crude product by allowing a predetermined oxidizing agent or the like to act on the nanodiamond crude product in an aqueous solvent (solution oxidation treatment) after the acid treatment described above. Examples of the oxidizing agent used in the solution oxidation treatment include chromic acid, chromic anhydride, dichromic acid, permanganic acid, perchloric acid, and salts of these compounds, nitric acid, and mixed acids (mixtures of sulfuric acid and nitric acid). In the solution oxidation treatment, one type of oxidizing agent may be used, or two or more types of oxidizing agents may be used. The concentration of the oxidizing agent used in the solution oxidation treatment is, for example, from 3 to 50 mass %. The amount of the oxidizing agent used in the solution oxidation treatment is, for example, from 300 to 2000 parts by mass relative to 100 parts by mass of the nanodiamond crude product for the solution oxidation treatment. The temperature for solution oxidation treatment is, for example, from 50 to 250° C. The duration of the solution oxidation treatment is, for example, from 1 to 72 hours. The solution oxidation treatment can be performed under reduced pressure, under normal pressure, or under increased pressure. After such a solution oxidation treatment, the solid (containing the nanodiamond aggregates) is washed with water, for example, by decantation. The supernatant from the initial water washing is colored, and thus the solid is preferably washed repeatedly with water by decantation until the supernatant becomes visually transparent.

The supernatant is removed, for example, by decantation, from the nanodiamond-containing solution having undergone this treatment, and then the residual fraction is subjected to a drying treatment to obtain a dry powder. Examples of the drying treatment technique include spray drying performed using a spray drying apparatus and evaporation to dryness using an evaporator.

In the next oxygen oxidation S3, the nanodiamond powder having undergone the purification S2 is heated using a gas atmosphere furnace in an atmosphere of gas of a predetermined composition containing oxygen. Specifically, the nanodiamond powder is placed in the gas atmosphere furnace, an oxygen-containing gas is fed into or passed through the furnace, the temperature inside the furnace is raised to a temperature condition set as the heating temperature, and the oxygen oxidation treatment is performed. The temperature condition of this oxygen oxidation treatment is, for example, from 250 to 500° C. To achieve a negative zeta potential for the ND particles contained in the ND dispersion to be produced, the temperature condition of this oxygen oxidation treatment is preferably relatively high, for example, from 400 to 450° C. In addition, the oxygen-containing gas used in the present embodiment is a mixed gas containing an inert gas in addition to oxygen. Examples of the inert gas include nitrogen, argon, carbon dioxide, and helium. The oxygen concentration of the mixed gas is, for example, from 1 to 35 vol. %.

To achieve a positive zeta potential for the ND particles contained in the ND dispersion to be produced, a hydrogen reduction treatment S3' is preferably performed after the oxygen oxidation S3 described above. In the hydrogen reduction treatment S3', the nanodiamond powder having undergone the oxygen oxidation S3 is heated using a gas atmosphere furnace in an atmosphere of gas of a predetermined composition containing hydrogen. Specifically, a hydrogen-containing gas is fed into or passed through the gas atmosphere furnace in which the nanodiamond powder is placed, the temperature inside the furnace is raised to a temperature condition set as the heating temperature, and the hydrogen reduction treatment is performed. The temperature condition of this hydrogen reduction treatment is, for example, from 400 to 800° C. In addition, the hydrogen-containing gas used in the present embodiment is a mixed gas containing an inert gas in addition to hydrogen. Examples of the inert gas include nitrogen, argon, carbon dioxide, and helium. The hydrogen concentration of the mixed gas is, for example, from 1 to 50 vol. %. To achieve a negative zeta potential for the ND particles contained in the ND dispersion to be produced, the following disintegration S4 may be performed without performing such a hydrogen reduction treatment.

The detonation nanodiamond may take the form of aggregates (secondary particles) even after undergoing a series of processes as described above including the purification, and the disintegration S4 is then performed to further separate primary particles from the aggregates. Specifically, first, the nanodiamond having undergone the oxygen oxidation S3 or the subsequent hydrogen reduction treatment S3' is suspended in pure water to prepare a slurry containing the nanodiamond. In preparing the slurry, a centrifugation treatment may be performed to remove relatively large aggregates from the nanodiamond suspension, or an ultrasonic treatment may be performed on the nanodiamond suspension. The slurry is then subjected to a wet disintegration treatment. The disintegration treatment can be performed using, for example, a high shearing mixer, a high shear mixer, a homomixer, a ball mill, a bead mill, a high-pressure homogenizer, an ultrasonic homogenizer, or a colloid mill. The disintegration treatment may also be performed by combining these means. In terms of efficiency, a bead mill is preferably used.

A bead mill, which is a milling apparatus or a disperser, includes, for example, a cylindrical mill vessel, a rotor pin, a centrifugation mechanism, a raw material tank, and a pump. The rotor pin is configured to have a common axial center with the mill vessel and to be rotatable at high speed inside the mill vessel. The centrifugation mechanism is disposed at an upper part inside the mill vessel. In bead milling using a bead mill in the disintegration, the slurry (containing the nanodiamond aggregates) is charged as a raw material from the raw material tank into a lower part of the mill vessel by the action of the pump, in a state in which the inside of the mill vessel is charged with a predetermined amount of beads and the rotor pin is stirring the beads. The slurry passes through the beads that are under high-speed stirring in the mill vessel and reaches the upper part inside the mill vessel. In this process, the nanodiamond aggregates contained in the slurry undergo action of milling or dispersion through contact with the vigorously moving beads. This advances the disintegration of the nanodiamond aggregates (secondary particles) into primary particles. The slurry and beads that have reached the centrifugation mechanism at the upper part inside the mill vessel are subjected to centrifugation that is based on differences in specific gravity by the centrifugation mechanism being in operation. The beads remain inside the mill vessel, and the slurry is discharged out of the mill vessel via a hollow line that is slidably connected to the centrifugation mechanism. The discharged slurry is returned to the raw material tank and then pumped back to the mill vessel by the action of the pump (circulation operation). In such bead milling, zirconia beads, for example, are used as the disintegration media, and the diameter of the beads is, for example, from 15 to 500 μm. The amount (apparent volume) of beads charged in the mill vessel is, for example, from 50 to 80% relative to the capacity of the mill vessel. The peripheral speed of the rotor pin is, for example, from 8 to 12 m/minute. The amount of the slurry to be circulated is, for example, from 200 to 600 mL, and the flow rate of the slurry is, for example, from 5 to 15 L/hour. In addition, the duration of the treatment (circulation operation time) is, for example, from 30 to 300 minutes. In the present embodiment, a batch bead mill may be used instead of a continuous bead mill as described above.

Through such disintegration S4, an ND dispersion containing nanodiamond primary particles can be obtained. The dispersion obtained through the disintegration S4 may be subjected to a classification operation to remove coarse particles. Coarse particles can be removed from the dispersion through a classification operation by centrifugation using, for example, a classification apparatus. This results in, for example, a black transparent ND dispersion in which primary particles of the nanodiamond are dispersed as colloidal particles.

In the present embodiment, the content or concentration of the ND particles 12 in the initial running-in agent composition 10 is 1.0 mass % (10000 ppm by mass) or less, preferably from 0.00005 to 0.5 mass %, more preferably from 0.0001 to 0.4 mass %, more preferably from 0.0005 to 0.3 mass %, and more preferably from 0.001 to 0.2 mass %, relative to the total mass of the composition. The initial running-in agent composition 10 is suitable for efficiently achieving low friction while reducing the content of the ND particles 12 to be contained with the water 11. Reducing the content of the ND particles 12 is preferred in terms of reducing the production cost of the initial running-in agent composition 10.

Figure 3:
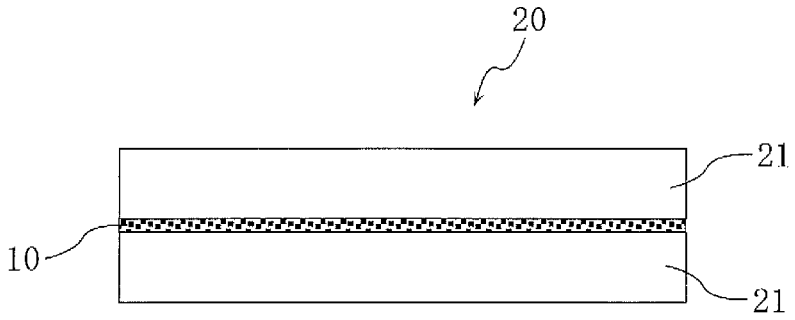
FIG. 3 is a conceptual schematic view of an initial running-in system according to one embodiment of the present invention.

FIG. 3 is a conceptual schematic view of an initial running-in system 20 according to one embodiment of the present invention. The initial running-in system 20 uses the initial running-in agent composition 10 as an initial running-in agent. In FIG. 3, the initial running-in system 20 includes a constitution including members 21 and the initial running-in agent composition 10. The members 21 have a sliding surface. A DLC film collectively refers to thin films (hard carbon thin films) made of a substance containing carbon as a main component, the carbon having carbon-carbon bonds of both diamond and graphite (black lead). A DLC sliding member refers to a member having the DLC film on the sliding surface of the member. The initial running-in agent composition 10 is typically replaced with a lubricant, such as water, after being used for initial rubbing (initial running-in). The initial running-in system 20 thus constituted is suitable for achieving low friction between the members 21 (in particular, low friction between DLC sliding members).

The DLC is a substance having excellent properties in abrasion resistance and slidability and suitably used as a coating material for members, such as sliding members. The properties of the DLC can be differentiated by the hydrogen content and by the proximity of the electron orbits of the contained crystalline material toward diamond or graphite. Examples of the DLC include amorphous hydrogenated carbon a-C:H, amorphous carbon a-C, tetrahedral amorphous carbon ta-C:H, and hydrogenated tetrahedral amorphous carbon ta-C.

EXAMPLES

Production of Nanodiamond Aqueous Dispersion X1

A nanodiamond aqueous dispersion X1 (ND aqueous dispersion X1) was produced through the following processes including formation, purification, oxygen oxidation, and disintegration.

In the formation, first, an electric detonator was attached to a molded explosive and then placed inside a pressure-resistant detonation vessel, and the vessel was sealed. The vessel is made of iron and has a capacity of 15 $m^3$. A mixture, 0.50 kg, of trinitrotoluene (TNT) and cyclotrimethylenetrinitroamine, namely hexogen (RDX), was used as the explosive. The mass ratio of TNT and RDX (TNT/RDX) in the explosive is 50/50. Next, the electric detonator was triggered, and the explosive was detonated in the vessel. Then the temperatures of the vessel and the inside of the vessel were decreased by allowing the vessel to stand at room temperature for 24 hours. After this cooling, the nanodiamond crude product (containing the nanodiamond aggregates formed by the detonation method described above and soot) deposited on the inner wall of the vessel was collected. The formation described above was performed several times, and thus the nanodiamond crude product was obtained.

Next, the nanodiamond crude product obtained in the formation described above was subjected to an acid treatment in the purification. Specifically, a slurry obtained by adding 6 L of a 10 mass % hydrochloric acid to 200 g of the nanodiamond crude product was subjected to a heat treatment under reflux at normal pressure conditions for 1 hour. The heating temperature in this acid treatment is from 85 to 100° C. Then, after cooling, the solid (containing the nanodiamond aggregates and soot) was washed with water by decantation. The solid was repeatedly washed with water by decantation until the pH of the precipitation solution reached 2 from the low pH side. Next, a mixed acid treatment was performed as the solution oxidation treatment in the purification. Specifically, a slurry was formed by adding 6 L of a 98 mass % sulfuric acid aqueous solution and 1 L of a 69 mass % nitric acid aqueous solution to the precipitate solution (containing the nanodiamond aggregates) obtained through decantation after the acid treatment, and then the slurry was subjected to a heat treatment under reflux at normal pressure conditions for 48 hours. The heating temperature in this oxidation treatment is from 140 to 160° C. Then, after cooling, the solid (containing the nanodiamond aggregates) was washed with water by decantation. The supernatant from the initial water washing was colored, and thus the solid was washed repeatedly with water by decantation until the supernatant became visually transparent. The drying was then performed. Specifically, 1000 mL of the nanodiamond-containing solution obtained through the water washing treatment described above was subjected to spray drying using a spray dryer (trade name "Spray Dryer B-290", available from Nihon Büchi Co., Ltd.). Thus, 50 g of nanodiamond powder was obtained.

The oxygen oxidation was then performed using a gas atmosphere furnace (trade name "Gas Atmosphere Tube Furnace KTF045N1", available from Koyo Thermo Systems Co., Ltd.). Specifically, 4.5 g of the nanodiamond powder obtained as described above was allowed to stand inside a furnace core tube of the gas atmosphere furnace, and nitrogen gas was continuously passed through the furnace core tube at a flow rate of 1 L/minute for 30 minutes. Then, the flowing gas was switched from nitrogen to a mixed gas of oxygen and nitrogen, and the mixed gas was continuously passed through the furnace core tube at a flow rate of 1 L/minute. The oxygen concentration in the mixed gas is 4 vol. %. After switching to the mixed gas, the temperature inside the furnace was raised to a temperature set for heating of 400° C. The temperature was raised at a rate of 10° C./minute to 380° C., a temperature 20° C. lower than the temperature set for heating, and then at a rate of 1° C./minute from 380° C. to 400° C. The oxygen oxidation treatment was then performed on the nanodiamond powder in the furnace while maintaining the temperature condition inside the furnace at 400° C. The duration of the treatment was 3 hours.

Figure 8:
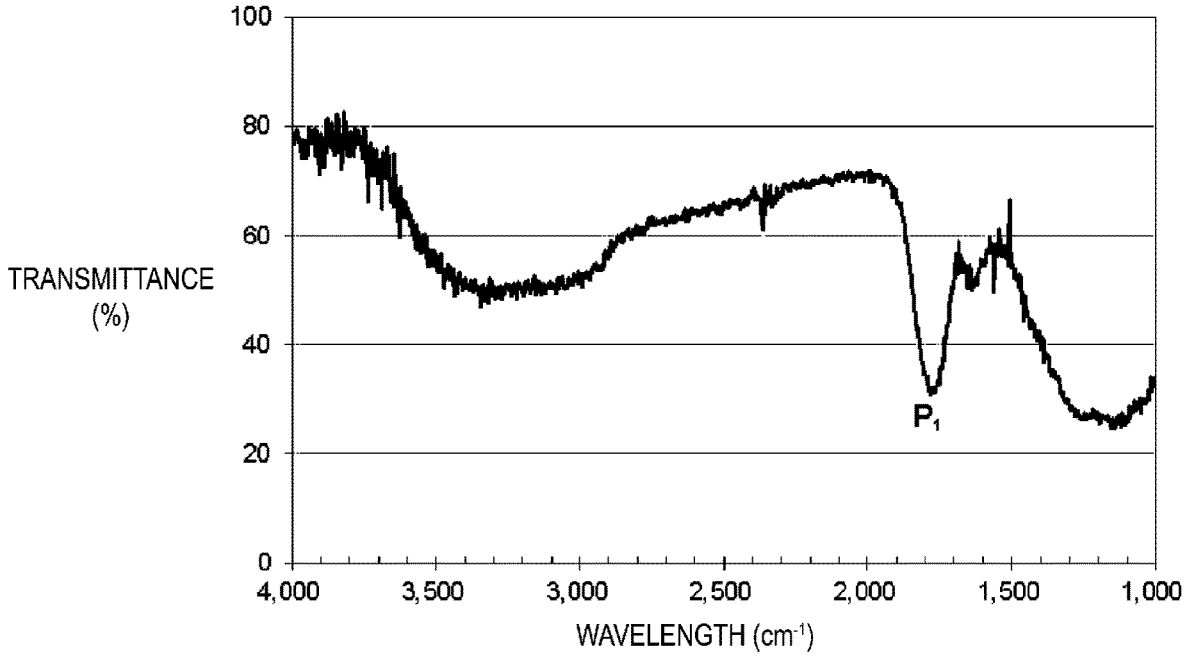
FIG. 8 is an FT-IR spectrum of ND particles after an oxygen oxidation treatment in production of an ND aqueous dispersion X1 of examples.

After the oxygen oxidation treatment, an oxygen-containing functional group, such as a carboxy group, on the ND particles was evaluated by FT-IR analysis according to the method described below. A spectrum obtained from this analysis is illustrated in FIG. 8. From FIG. 8, an absorption $P_1$ was detected as a main peak at or around 1780 $cm^{-1}$ attributed to C=O stretching vibration. With this peak position of 1750 $cm^{-1}$ or greater, the ND particles can be a raw material for the nanodiamond dispersion with a negative zeta potential.

The disintegration was then performed. Specifically, first, 1.8 g of the nanodiamond powder having undergone the oxygen oxidation and 28.2 mL of pure water were mixed in a 50-mL sample bottle, and about 30 mL of slurry was obtained. Next, the pH of the slurry was adjusted by adding a 1 M aqueous sodium hydroxide solution and then treated ultrasonically. In the ultrasonic treatment, the slurry was subjected to ultrasonic irradiation for 2 hours using an ultrasonic irradiator (trade name "Ultrasonic Cleaner AS-3", available from AS ONE Corporation). Thereafter, bead milling was performed using a bead milling apparatus (trade name "Parallel 4-Tube Sand Grinder Model LSG-4U-2L", available from Aimex Co., Ltd.). Specifically, 30 mL of the slurry after the ultrasonic irradiation and zirconia beads with a diameter of 30 μm were charged in a 100-mL vessel (available from Aimex Co., Ltd.), which was the mill vessel, and the vessel was sealed. Then, the apparatus was operated to perform bead milling. In this bead milling, the amount of zirconia beads charged is about 33% relative to the capacity of the mill vessel, the rotation speed of the mill vessel is 2570 rpm, and the duration of the milling is 2 hours. Then, the slurry or suspension having undergone such disintegration was subjected to a centrifugation treatment (classification operation) using a centrifuge. The centrifugal force in this centrifugation treatment was 20000×g, and the duration of the centrifugation was 10 minutes. Next, 10 mL of supernatant of the nanodiamond-containing solution having undergone the centrifugation treatment was collected. The ND aqueous dispersion X1 in which nanodiamond was dispersed in pure water was thus obtained. The ND aqueous dispersion X1 is a stock solution of the initial running-in agent composition. This ND aqueous dispersion X1 had a solid concentration or nanodiamond concentration of 59.1 g/L and a pH of 9.33. The ND aqueous dispersion X1 had a particle size D50 (median diameter) of 3.97 nm, a particle size D90 of 7.20 nm, and a zeta potential of −42 mV.

Production of Nanodiamond Aqueous Dispersion Y1

A nanodiamond aqueous dispersion Y1 (ND aqueous dispersion Y1) was produced by further subjecting the nanodiamond powder obtained through the formation, the purification, and the oxygen oxidation for the ND aqueous dispersion X1 to a hydrogen reduction treatment, a pre-treatment before disintegration, a disintegration treatment, and a classification, as described below.

The hydrogen reduction treatment was then performed using a gas atmosphere furnace (trade name "Gas Atmosphere Tube Furnace KTF045N1", available from Koyo Thermo Systems Co., Ltd.). Specifically, 50 g of the nanodiamond powder was allowed to stand in a tube furnace of the gas atmosphere furnace, and the pressure inside the tube furnace was reduced. The tube furnace was allowed to stand for 10 minutes, and then argon gas was purged inside of the tube furnace. The process from pressure reduction to argon purge was repeated totally three times, and argon gas was continuously passed through the tube furnace. The inside of the furnace was thus replaced with an argon atmosphere. Thereafter, the flowing gas was switched from argon to hydrogen (purity: 99.99 vol. % or greater), and hydrogen gas was continuously passed through the tube furnace at a flow rate of the hydrogen gas of 4 L/minutes for 30 minutes. Then, the temperature inside the furnace was raised to 600° C. over 2 hours and then maintained at 600° C. for 5 hours. After the heating was stopped, the inside of the furnace was naturally cooled. After the temperature inside the furnace reached room temperature, the flowing gas was switched from hydrogen to argon, and argon gas was passed through the tube furnace for 10 hours. After the flow of argon gas was stopped, the nanodiamond powder was allowed to stand for 30 minutes and then collected from the inside of the furnace. The collected nanodiamond powder was 44 g.

Figure 9:
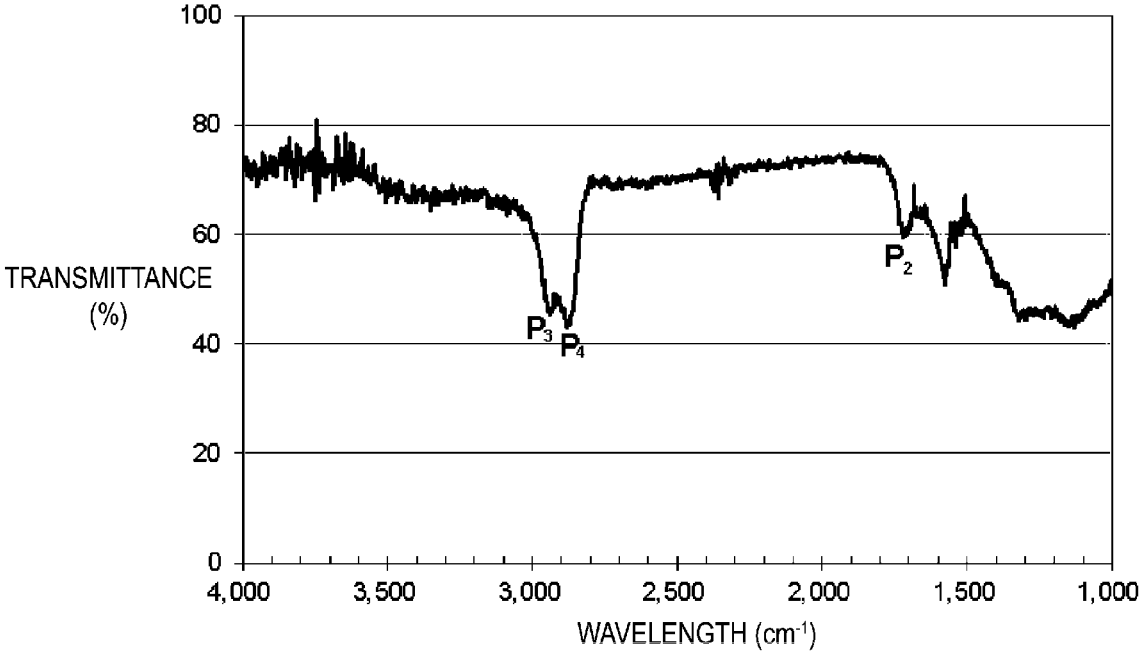
FIG. 9 is an FT-IR spectrum of ND particles after a hydrogen reduction treatment in production of an ND aqueous dispersion Y1 of examples.

After the hydrogen reduction treatment, an oxygen-containing functional group, such as a carboxy group, on the ND particles was evaluated by FT-IR analysis according to the method described below. A spectrum obtained by this analysis is illustrated in FIG. 9. FIG. 9 reveals that the absorption $P_1$ at or around 1780 $cm^{-1}$ attributed to C═O stretching vibration detected by the oxygen oxidation treatment seen in FIG. 8 has disappeared by undergoing the hydrogen reduction treatment. Such disappearance of the absorption $P_1$ clearly confirms a absorption P2 at or around 1730 $cm^{-1}$ attributed to C═C stretching vibration. Furthermore, FIG. 9 reveals that an absorption $P_3$ at or around 2870 $cm^{-1}$ and an absorption $P_4$ at or around 2940 $cm^{-1}$ attributed to C—H stretching vibration of a methylene group appeared as a characteristic absorption by subjecting the nanodiamond particles to the hydrogen reduction treatment. These results reveal that in the hydrogen reduction treatment, hydrogen reduction proceeded sufficiently on the nanodiamond surface, that is, the oxygen functional group, such as a carboxy group, that can be present on the nanodiamond surface was reduced, and the formation of the hydrogen-terminated structure proceeded sufficiently. The ND particles in this state can be a raw material for the nanodiamond dispersion with a positive zeta potential.

The pre-treatment before disintegration was then performed. Specifically, first, ultrapure water was added to 8.4 g of the hydrogen reduced nanodiamond powder obtained through the hydrogen reduction treatment to obtain 280 g of a suspension, and a slurry was obtained by stirring the suspension with a stirrer at room temperature for 1 hour. Next, 1 M hydrochloric acid was added to adjust the pH to 4. Then, the slurry was subjected to an ultrasonic cleaning treatment for 2 hours using an ultrasonic irradiator (trade name Ultrasonic Cleaner AS-3", available from AS ONE Corporation).

Then, 280 g of the slurry obtained in the pre-treatment before disintegration described above was subjected to the disintegration by bead milling using a bead milling apparatus (trade name "Bead Mill RMB", available from Aimex Co., Ltd.). In the disintegration, 280 mL of zirconia beads with a diameter of 30 μm used as the disintegration media were charged to 280 g of the slurry in a mill vessel, and a rotating blade was driven to rotate in the mill vessel at a peripheral speed of 8 m/second for a milling time of 2 hours.

The classification was then performed. Specifically, coarse particles were removed from the slurry having undergone the disintegration treatment described above by a classification operation using centrifugation (20000×g, 10 minutes). As described above, the ND aqueous dispersion Y1 in which nanodiamond was dispersed in pure water was obtained. The ND aqueous dispersion Y1 is a stock solution of the initial running-in agent composition in which the hydrogen reduced nanodiamond particles are dispersed in water as a lubricant base. This ND aqueous dispersion Y1 had a solid concentration or a nanodiamond concentration of 3.1 mass %, a particle size D50 (median diameter) of 6.0 nm, an electrical conductivity of 70 μS/cm, a pH of 4.5, and a zeta potential of +48 mV.

Nanodiamond Concentration

The nanodiamond contents (ND concentrations) of the resulting ND aqueous dispersions X1 and Y1 were calculated based on: a weighed value of the dispersion weighed in a range from 3 to 5 g; and a weighed value of a dried product (powder) remaining after water was evaporated from the weighed dispersion by heating, the weighed value of the dried product being weighed with a precision balance.

Particle Size

The particle sizes (median diameters, D50 or D90) of the nanodiamond particles contained in the resulting ND aqueous dispersions X1 and Y1 were measured by dynamic light scattering (non-contact backscattering) using an instrument (trade name "Zetasizer Nano ZS") available from Malvern Panalytical Ltd. The ND aqueous dispersions X1 and Y1 for the measurements were prepared by dilution with ultrapure water to solid concentrations or nanodiamond concentrations from 0.5 to 2.0 mass %, followed by ultrasonic irradiation with an ultrasonic cleaner.

pH

The pH of the resulting ND aqueous dispersions X1 and Y1 was measured using pH test paper (trade name "Three Band pH Test Paper", available from AS ONE Corporation).

Zeta Potential

The zeta potentials of the nanodiamond particles contained in the resulting ND aqueous dispersions X1 and Y1 were measured by Laser Doppler electrophoresis using an instrument (trade name "Zetasizer Nano ZS") available from Malvern Panalytical Ltd. The ND aqueous dispersions X1 and Y1 for the measurements were prepared by dilution with ultrapure water to solid concentrations or nanodiamond concentrations of 0.2 mass %, followed by ultrasonic irradiation with an ultrasonic cleaner. The zeta potentials were measured at a temperature of 25° C.

FT-IR Analysis

Each of the nanodiamond samples after the oxygen oxidation treatment and after the hydrogen reduction treatment described above was subjected to Fourier transform infrared spectroscopy (FT-IR) using an FT-IR instrument (trade name "Spectrum 400 FT-IR", available from PerkinElmer Co., Ltd.). In this measurement, the infrared absorption spectrum was measured while heating the sample to be measured to 150° C. in a vacuum atmosphere. Heating in a vacuum atmosphere was implemented using a Model-HC 900 Heat Chamber and a TC-100WA Thermo Controller, available from ST Japan INC., in combination.

Example 1

An initial running-in agent composition containing 0.1 mass % of nanodiamond particles (aqueous solution containing 0.1 mass % of ND particles) was prepared by mixing the ND aqueous dispersion X1 obtained above and ultrapure water and adjusting the concentration.

Example 2

An initial running-in agent composition containing 0.001 mass % of nanodiamond particles (aqueous solution containing 0.001 mass % of ND particles) was prepared by mixing the ND aqueous dispersion X1 obtained above and ultrapure water and adjusting the concentration.

Example 3

An initial running-in agent composition containing 0.001 mass % of nanodiamond particles (aqueous solution containing 0.001 mass % of ND particles) was prepared by mixing the ND aqueous dispersion Y1 obtained above and ultrapure water and adjusting the concentration.

Comparative Example 1

Only water (ultrapure water) containing no nanodiamond particles was used.

Friction Test

Figure 4:
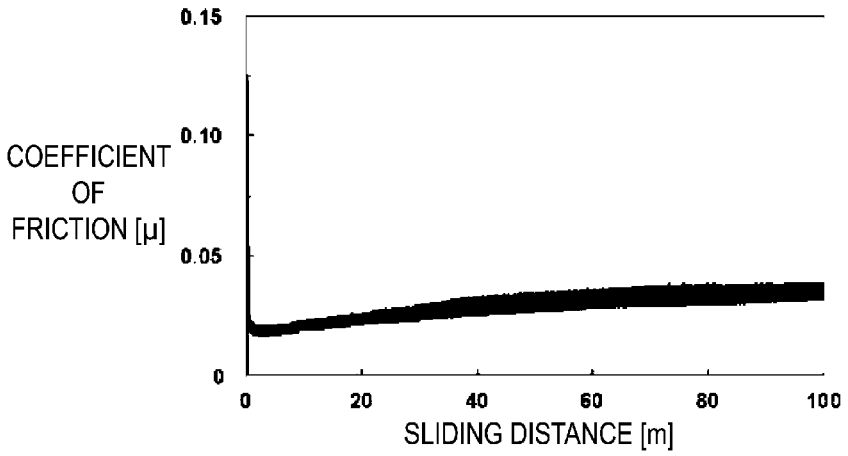
FIG. 4 is a graph illustrating a result of a friction test using only water (Comparative Example 1).
Figure 5:
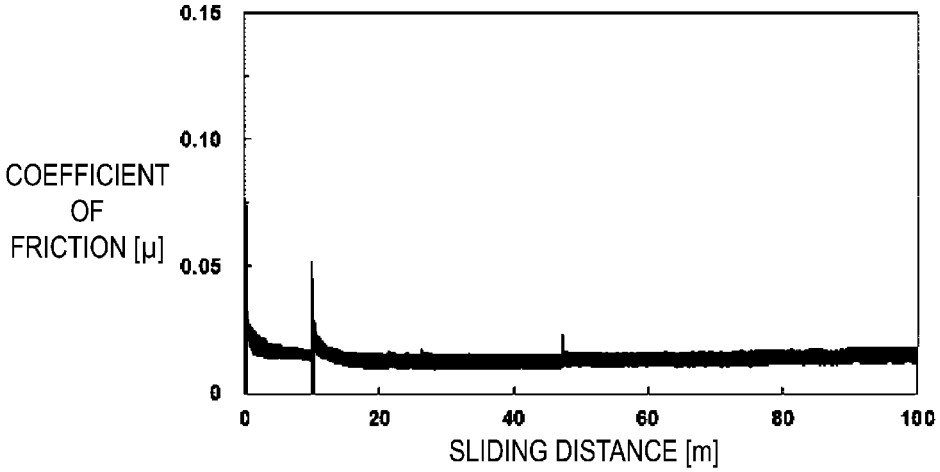
FIG. 5 is a graph illustrating a result of a friction test using an initial running-in agent composition of Example 1.
Figure 6:
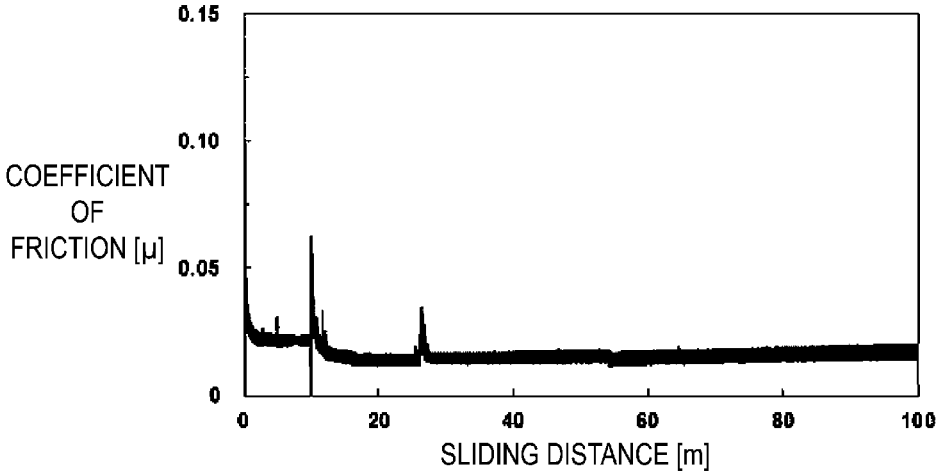
FIG. 6 is a graph illustrating a result of a friction test using an initial running-in agent composition of Example 2.
Figure 7:
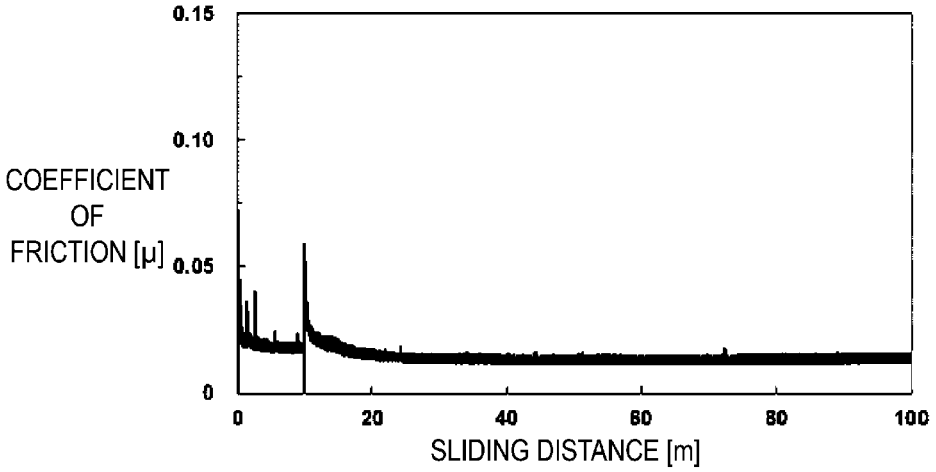
FIG. 7 is a graph illustrating a result of a friction test using an initial running-in agent composition of Example 3.

A ball-on-disk sliding friction tester was used for a friction test. Using an SUJ2 ball with a diameter of 8 mm and a SUJ2 disk with a diameter of 30 mm and a thickness of 4 mm as base materials, a DLC film available from Tohken Thermo Tech Co., Ltd. was deposited at a thickness of about 3 μm on the sliding surfaces of the ball and the disk. The initial running-in agent compositions of Example 1 (aqueous solution containing 0.1 mass % of X1 particles), Example 2 (aqueous solution containing 0.001 mass % of X1 particles), and Example 3 (aqueous solution containing 0.001 mass % of Y1 particles) were used. At the start of the test, 1 mL of the initial running-in agent composition was dropped to the sliding surface of the disk surface, and the test was performed at room temperature. The test conditions were a sliding velocity of 10 mm/s, a load of 10 N, and a sliding distance of 100 m. In addition, the test was also performed for Comparative Example 1 (water only) in the same manner. In Examples 1 to 3, first, as an initial running-in (pre-sliding), the ball and the disk were allowed to slide 10 m with the initial running-in agent composition, then the ball and the disk were removed from the friction tester and subjected to an ultrasonic cleaning treatment in purified water for 15 minutes. After the cleaning, the water droplet was removed to resume the test using water as the lubricating fluid, and the ball and the disk were allowed to slide 90 m. FIG. 4 illustrates the result for Comparative Example 1 (water only), FIG. 5 illustrates the result for Example 1 (aqueous solution containing 0.1 mass % of ND particles), FIG. 6 illustrates the result for Example 2 (aqueous solution containing 0.001 mass % of ND particles), and FIG. 7 illustrates the result for Example 3 (aqueous solution containing 0.001 mass % of ND particles). In FIGS. 4 to 7, the horizontal axis represents the sliding distance [m], and the vertical axis represents the coefficient of friction [μ].

From FIGS. 4 to 7, it was found that in Comparative Example 1 (FIG. 4) with water only, the coefficient of friction gradually increased with increasing sliding distance, whereas in Examples 1 to 3 (FIGS. 5 to 7) in which initial running-in (pre-sliding) was performed, no increase in the coefficient of friction was found at a sliding distance of 100 m, and low friction is maintained. In addition, a low-friction surface (running-in surface) was successfully formed at an early stage with the short pre-sliding of 10 m. Thus, the initial running-in agent composition according to an embodiment of the present invention can allow formation of a low-friction surface (running-in surface) on the sliding portion at an early stage and can achieve subsequently low friction between sliding members.

To summarize the above, the constitutions and variations of the present invention are listed below as addenda.

[Addendum 1]

An initial running-in agent composition containing water as a lubricant base and nanodiamond particles.

[Addendum 2]

The initial running-in agent composition according to addendum 1, wherein a content of the water is 99 mass % or greater, and a content of the nanodiamond particles is 1.0 mass % or less.

[Addendum 3]

The initial running-in agent composition according to addendum 1 or 2, wherein the content of the nanodiamond particles is from 0.5 to 2000 ppm by mass.

[Addendum 4]

The lubrication system according to any one of addenda 1 to 3, wherein a particle size of primary particles of the nanodiamond particles is 10 nm or smaller.

[Addendum 5]

The initial running-in agent composition according to any one of addenda 1 to 4, wherein the nanodiamond particles are an oxygen oxidation product of detonation nanodiamond particles.

[Addendum 6]

The initial running-in agent composition according to any one of addenda 1 to 5, wherein a zeta potential of the nanodiamond particles is negative.

[Addendum 7]

The initial running-in agent composition according to addendum 6, wherein the zeta potential of the nanodiamond particles is from −60 to −30 mV.

[Addendum 8]

The initial running-in agent composition according to any one of addenda 1 to 7, wherein a peak position attributed to C═O stretching vibration in FT-IR of the nanodiamond particles is 1750 $cm^{-1}$ or greater.

[Addendum 9]

The initial running-in agent composition according to any one of addenda 1 to 4, wherein the nanodiamond particles are a hydrogen reduction product of detonation nanodiamond particles.

[Addendum 10]

The initial running-in agent composition according to any one of addenda 1 to 4 and 9, wherein the zeta potential of the nanodiamond particles is positive.

[Addendum 11]

The initial running-in agent composition according to addendum 10, wherein the zeta potential of the nanodiamond particles is from 30 to 60 mV.

[Addendum 12]

The initial running-in agent composition according to any one of addenda 1 to 4 and 9 to 11, wherein the peak position attributed to C═O stretching vibration in FT-IR of the nanodiamond particles is less than 1750 $cm^{-1}$.

[Addendum 13]

The initial running-in agent composition according to any one of addenda 1 to 12, wherein the composition is used for lubricating a DLC member.

[Addendum 14]

An initial running-in system including the initial running-in agent composition described in any one of addenda 1 to 13 and a DLC member.

[Addendum 15]

The initial running-in system according to addendum 14, wherein a DLC in the DLC member is at least one selected from the group consisting of amorphous hydrogenated carbon (a-C:H), amorphous carbon (a-C), tetrahedral amorphous carbon (ta-C:H), and hydrogenated tetrahedral amorphous carbon (ta-C).

REFERENCE SIGNS LIST

10 Initial running-in agent composition
11 Water
12 Nanodiamond particles
20 Initial running-in system
21 DLC member
S1 Formation
S2 Purification
S3 Oxygen oxidation
S3' Hydrogen reduction treatment
S4 Disintegration

The invention claimed is:

1. An initial running-in system comprising:

an initial running-in agent composition containing water as a lubricant base; and nanodiamond particles; and a member having a sliding surface.

2. The initial running-in system according to claim 1, wherein a content of the water is 99 mass % or greater, and a content of the nanodiamond particles is 1.0 mass % or less.

3. The initial running-in system according to claim 1, wherein the content of the nanodiamond particles is from 0.5 to 2000 ppm by mass.

4. The initial running-in system according to claim 1, wherein the nanodiamond particles are an oxygen oxidation product of detonation nanodiamond particles.

5. The initial running-in system according to claim 1, wherein a zeta potential of the nanodiamond particles is negative.

6. The initial running-in system according to claim 1, wherein a peak position attributed to C═O stretching vibration in FT-IR of the nanodiamond particles is 1750 $cm^{-1}$ or greater.

7. The initial running-in system according to claim 1, wherein the nanodiamond particles are a hydrogen reduction product of detonation nanodiamond particles.

8. The initial running-in system according to claim 1, wherein the zeta potential of the nanodiamond particles is positive.

9. The initial running-in system according to claim 1, wherein the peak position attributed to C═O stretching vibration in FT-IR of the nanodiamond particles is less than 1750 $cm^{-1}$.

10. The initial running-in system according to claim 1, wherein the composition is used for lubricating the member having a sliding surface comprises.

11. An initial running-in system according to claim 1 wherein the member having a sliding surface comprises a a diamond-like-carbon (DLC) member.

12. The initial running-in system according to claim 1, wherein a particle size of primary particles of the nanodiamond particles is 10 nm or less.

13. The initial running-in system according to claim 5, wherein the zeta potential of the nanodiamond particles is from −60 to −30 mV.

14. The initial running-in system according to claim 8, wherein the zeta potential of the nanodiamond particles is from 30 to 60 mV.

15. The initial running-in system according to claim 1, wherein the nanodiamond particles are dispersed as primary particles separated from each other in the initial running-in agent composition.

16. The initial running-in system according to claim 1, wherein the nanodiamond particles comprise detonation nanodiamond particles.

17. The initial running-in system according to claim 1, wherein the particle size of the primary particles of the nanodiamond particles is 1 nm or greater.

18. The initial running-in system according to claim 1, wherein the nanodiamond particles are dispersed as primary particles separated from each other in the initial running-in agent composition, the particle size of the primary particles of the nanodiamond particles is 1 nm or greater and 10 nm or less, the nanodiamond particles are an oxygen oxidation product of detonation nanodiamond particles, the zeta potential of the nanodiamond particles is from −60 to −30 mV, the peak position attributed to C═O stretching vibration in FT-IR of the nanodiamond particles is 1750 $cm^{-1}$ or greater, and the content of the water is 99 mass % or greater, and the content of the nanodiamond particles is from 0.5 to 2000 ppm by mass.

19. The initial running-in system according to claim 1, wherein the nanodiamond particles are dispersed as primary particles separated from each other in the initial running-in agent composition, the particle size of the primary particles of the nanodiamond particles is 1 nm or greater and 10 nm or less, the nanodiamond particles are a hydrogen reduction product of detonation nanodiamond particles, the zeta potential of the nanodiamond particles is from 30 to 60 mV, the peak position attributed to C═O stretching vibration in FT-IR of the nanodiamond particles is less than 1750 $cm^{-1}$, and the content of the water is 99 mass % or greater, and the content of the nanodiamond particles is from 0.5 to 2000 ppm by mass.

20. The initial running-in system according to claim 11, wherein DLC in the DLC member is at least one selected from the group consisting of amorphous hydrogenated carbon (a-C:H), amorphous carbon (a-C), tetrahedral amorphous carbon (ta-C:H), and hydrogenated tetrahedral amorphous carbon (ta-C).

* * * * *